US006227307B1

(12) United States Patent
Lee

(10) Patent No.: US 6,227,307 B1
(45) Date of Patent: May 8, 2001

(54) SOUND AND DUST PROOF BREAKER

(75) Inventor: Won-Hae Lee, Kyunggi-do (KR)

(73) Assignee: Daemo Engineering Co., LTD, Seoul (KR)

( * ) Notice: Subject to any disclaimer, the term of this patent is extended or adjusted under 35 U.S.C. 154(b) by 0 days.

(21) Appl. No.: 09/378,964

(22) Filed: Aug. 23, 1999

(30) Foreign Application Priority Data

Dec. 4, 1998 (KR) ..... 98-24159

(51) Int. Cl.[7] ..... B25D 17/14; B25D 17/11

(52) U.S. Cl. ..... 173/78; 173/61; 173/162.1; 173/199; 173/210; 173/211

(58) Field of Search ..... 173/78, 80, 199, 173/DIG. 2–4, 162.1, 162.2, 210–212, 61, 62, 74; 267/137; 181/230

(56) References Cited

U.S. PATENT DOCUMENTS

| | | | | |
|---|---|---|---|---|
| 819,756 | * | 5/1906 | Hellman et al. | 173/61 |
| 2,033,527 | * | 3/1936 | Kitching | 173/61 |
| 2,059,048 | * | 10/1936 | Slater | 173/78 |
| 2,558,165 | | 6/1951 | Anderson | 173/206 |
| 2,748,750 | * | 6/1956 | Altschuler | 173/162.1 |
| 3,168,324 | | 2/1965 | Kennell | 173/210 |
| 3,198,265 | * | 8/1965 | Voelkerding | 173/74 |
| 3,223,181 | | 12/1965 | Price | 173/162.1 |
| 3,332,504 | * | 7/1967 | Lowery | 173/DIG. 2 |
| 3,456,744 | * | 7/1969 | Altschuler | 173/212 |
| 3,496,840 | * | 2/1970 | Wandel et al. | 173/210 |
| 3,524,511 | * | 8/1970 | Klemm | 173/78 |
| 3,559,753 | | 2/1971 | Meri et al. | 173/210 |
| 3,662,855 | | 5/1972 | Adams et al. | 173/210 |
| 3,735,824 | | 5/1973 | Aström | 173/210 |
| 3,757,875 | * | 9/1973 | Gunning | 173/DIG. 2 |
| 4,018,291 | * | 4/1977 | Anderson | 173/DIG. 2 |
| 4,327,807 | * | 5/1982 | Emonet | 173/DIG. 2 |
| 4,382,475 | | 5/1983 | Suzuki | 173/162.1 |
| 4,402,383 | * | 9/1983 | Bailey | 173/162.1 |
| 4,440,237 | | 4/1984 | Casperovich | 173/206 |
| 4,624,339 | * | 11/1986 | Marcel et al. | 173/DIG. 2 |
| 4,838,363 | | 6/1989 | MacOnochie | 173/210 |
| 4,854,393 | * | 8/1989 | Palet | 173/62 |
| 5,285,858 | * | 2/1994 | Okada et al. | 173/162.1 |
| 5,370,193 | * | 12/1994 | Sippus et al. | 173/162.1 |
| 5,419,404 | * | 5/1995 | Niemi et al. | 173/162.1 |

FOREIGN PATENT DOCUMENTS

| | | | | |
|---|---|---|---|---|
| 2237528 | * | 5/1991 | (GB) | 173/DIG. 2 |

* cited by examiner

*Primary Examiner*—Peter Vo
*Assistant Examiner*—Jim Calve
(74) *Attorney, Agent, or Firm*—Robert E. Bushnell, Esq.

(57) ABSTRACT

A hydraulic breaker for absorbing and reducing vibration and noise generated from the breaker and for reducing debris and dust scattered from the impact tool during using the breaker is provided. Space between main body of the breaker and outer housing is filled with fluid supplied from outside of the outer housing. Fluid hose is connected to a fluid hole formed on the outer housing to supply fluid into the space. Upper absorber is disposed between a bracket and upper portion of the main body, lower absorber is disposed between front cover of the outer housing and front head portion of the main body. Side absorbers are disposed between sidewall of the outer housing and outer cylindrical sidewall of the main body to keep a distance between outer housing and main body and to provide the space filled with fluid. Fluid, such as water, filled in the space is ejected through holes formed on the front cover of the outer housing. The ejected water prevents debris and dust generated during operation of the breaker from being scattered.

26 Claims, 8 Drawing Sheets

SOUND AND DUST PROOF BREAKER

CLAIM OF PRIORITY

This application makes reference to, incorporates the same herein, and claims all benefits accruing under 35 U.S.C. §119 from an application for APPARATUS TO SOUND PROOFING AND PREVENT VIBRATION OF BREAKER earlier filed in the Korean Industrial Property Office on the Dec. $4^{th}$ 1998 and there duly assigned Ser. No. 24159/1998.

BACKGROUND OF THE INVENTION

1. Field of the Invention

The present invention relates to a sound and vibration proof breaker, and more particularly to a sound proof apparatus for absorbing and reducing both noise and vibration generated by the breaker while minimizing the scattering of debris and dust generated by the breaker from being scattered.

2. Description of the Related Art

Various types of noise and vibration proof apparatus are used in a breaker such as a pneumatic or hydraulic jack hammer. Typically, an absorber attached to a portion of the breaker is used to attenuate noise and vibration. A reciprocating drive piston that is powered by hydraulic liquid in main body of the breaker repeatedly drives a hammer piston to impact upon and to return from a tool grasped by a front head portion of the main body in the breaker. During this operation, noise and vibration generated from the breaker can be earsplitting in intensity and may cause users of the breaker to be damaged psychologically and physically. In order to reduce this problem, various types of absorbers have been used in efforts to reduce the noise and vibration. I have found that with these conventional apparatus and methods, noise and vibration can not be absorbed and reduced effectively and significantly, and that it is impossible to collect or otherwise improve the conventional apparatus and method in order to get a more perfect apparatus and method for absorbing and reducing both noise and vibration generated by the breaker.

German publication number DE 4,030,126A for a Hydraulic Road Drill Casing discloses a hydraulic drill totally enclosed in a sandwich casing formed from an outer shell and inner shell. A filler, such as fine-grained sand or other relatively incompressible damping material, is filled in a space between the outer shell and inner shell of the sandwich casing. Plastic pads provide radial and end support between the hydraulic drill and casing. The filler, such as fine-grained sand or other relatively incompressible damping material, however is easily crashed by repeated vibration. Moreover, the filler accumulates in the bottom side of the sandwich casing, and the upper portion of the sandwich casing can be vacated. Therefore, I have noticed that this apparatus has several critical defects and that the filler can not absorb and reduce the vibration and the noise effectively during operation of the hydraulic drill.

U.S. Pat. No. 4,838,363 for a Rock-Breaking Apparatus issued to MacOnochie discloses an annulus made from a piece of shock-absorbing material, such as a relatively dense plastic or elastomeric material capable of deformation and restoration of its original shape after deformation, that is located within guide column in order to minimizing the effect of the weight of the tool on the other part of the rock-breaking apparatus. U.S. Pat. No. 4,440,237 for a Pavement Breaker issued to Casperovich discloses a compression chamber and a pair of expansion chambers used for reducing the shock effect transmitted by the reciprocating piston to housing. U.S. Pat. No. 3,662,855 for Muffled Tool For Vibratory or Impact Machines issued to Adams et al. discloses a tool for vibratory impact machines that has a collar of vibration damping material mounted on extended around the body of the tool. U.S. Pat. No. 3,559,753 for a Percussion Tool issued to Meri discloses a percussion tool such as an air hammer having a spring absorbing the shock of the downward stroke of the scissor. U.S. Pat. No. 3,168,324 for a Chuck issued to Kennell discloses a pneumatic percussion tool having a cushion to reduce the shock of the floor from the chuck striking the cushion. I have noticed that the embodiments disclosed by these references does not absorb and reduce the vibration and noise effectively because the absorber is partially located on an operational part of the machine.

U.S. Pat. No. 4,382,475 for a Hydraulic Hammer Apparatus issued to Suzuki discloses a hydraulic hammer apparatus including a fluid chamber filled with fluid for preventing noise made by the collision from being externally propagated the noise is absorbed by the fluid and this prevents the heavy vibration made by the collision from being emitted. U.S. Pat. No. 2,558,165 for a Cushioning Device For Rock Drill issued to Anderson discloses rock drills having a cavity filled with fluid under pressure in order to absorb any shocks applied to the chuck by the drill steel. I have noticed that the embodiments taught by these references do not absorb and reduce the vibration and noise effectively because the fluid fills only a portion of the circumferential surface of the machine.

U.S. Pat. No. 3,735,824 for an Arrangement In and Relating To a Chiselling Hammers or Similar Percussion Machine issued to Astrom discloses a motor housing made of a damping material with a passage in the machine housing. A quantity of dust produced at the tip of the tool is collected and removed through the passage. U.S. Pat. No. 3,223,181 for a Vibrationless Air Hammer Assembly issued to Price is equipped with air exhaust ports. Air discharged from the port of the air motor into the casing is discharged downwardly through the air exhaust ports, in an effort to reduce the noise that accompanies the discharge of air from the port. I have found however, that these embodiments do not prevent the debris and dust from being scattered.

In my opinion, the apparatus and techniques, represented by this art are neither adequate to absorb and reduce the noise and vibration generated by the breaker nor effective to reliably prevent the scattering of debris and dust which may cause the user to be injured and nearby property to be damaged.

SUMMARY OF THE INVENTION

It is an object of the present invention to provide an improved apparatus and process for absorbing the vibration generated by a breaker.

It is another object to provide an apparatus and process able to attenuate the vibration and noise generated by a breaker.

It is an yet another object to provide an apparatus for preventing debris and dust generated by the end-tip of an impact tool of the breaker from being scattered.

It is still another object to provide an apparatus for preventing a user from being injured during the use of a breaker.

It is still yet object to provide an apparatus for maintaining the quantity of fluid that fills the space between a body of the breaker and an outer housing so as to assure continual absorption and reduction of vibration and noise over the operational lifetime of the tool.

It is further object to provide an apparatus for protecting users from psychologically and physically damaged due to the operation of the breaker.

It is also an object to provide an apparatus for using fluid within a space between a body of the breaker and an outer housing both for absorbing and reducing vibration and noise and for preventing scattering of debris and dust generated by a end-tip of a tool held by the breaker during operation.

These and other objects may be achieved by providing a space between a main body of the breaker and an outer housing that is filled with liquid, such as water or oil. An upper absorber such as polyurethane or nitrile-budadiene rubber, is inserted between a cap portion of the main body and upper bracket, and a lower absorber such as polyurethane or nitrile-budadiene rubber, is inserted between the front head portion of the main body and a front cover of the outer housing. Side absorbers such as polyurethane or nitrile-budadiene rubber, are inserted into the space to maintain a distance between the main body and the outer housing and to maintain the shape of the space. The combination of the water, the upper absorber, the lower absorber, and the side absorbers significantly absorb and reduce the vibration and noise generated by the breaker during operation.

A fluid hole is formed on the outer housing and is connected to a fluid hose, and water is supplied into the space through the fluid hole and the fluid hose. A plurality of hydraulic holes are formed on the outer housing, and hydraulic tubes are connected to the hydraulic inlet and outlet formed on the main body through the hydraulic hole. A plurality of holes form nozzles in the outer housing near the impact tool, and the water is ejected to the end of the impact tool through the nozzles. Water may be ejected through a passage formed on the absorber and the nozzle hole or only through the nozzles. Water is supplied the space through the fluid hose during operation of the breaker.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
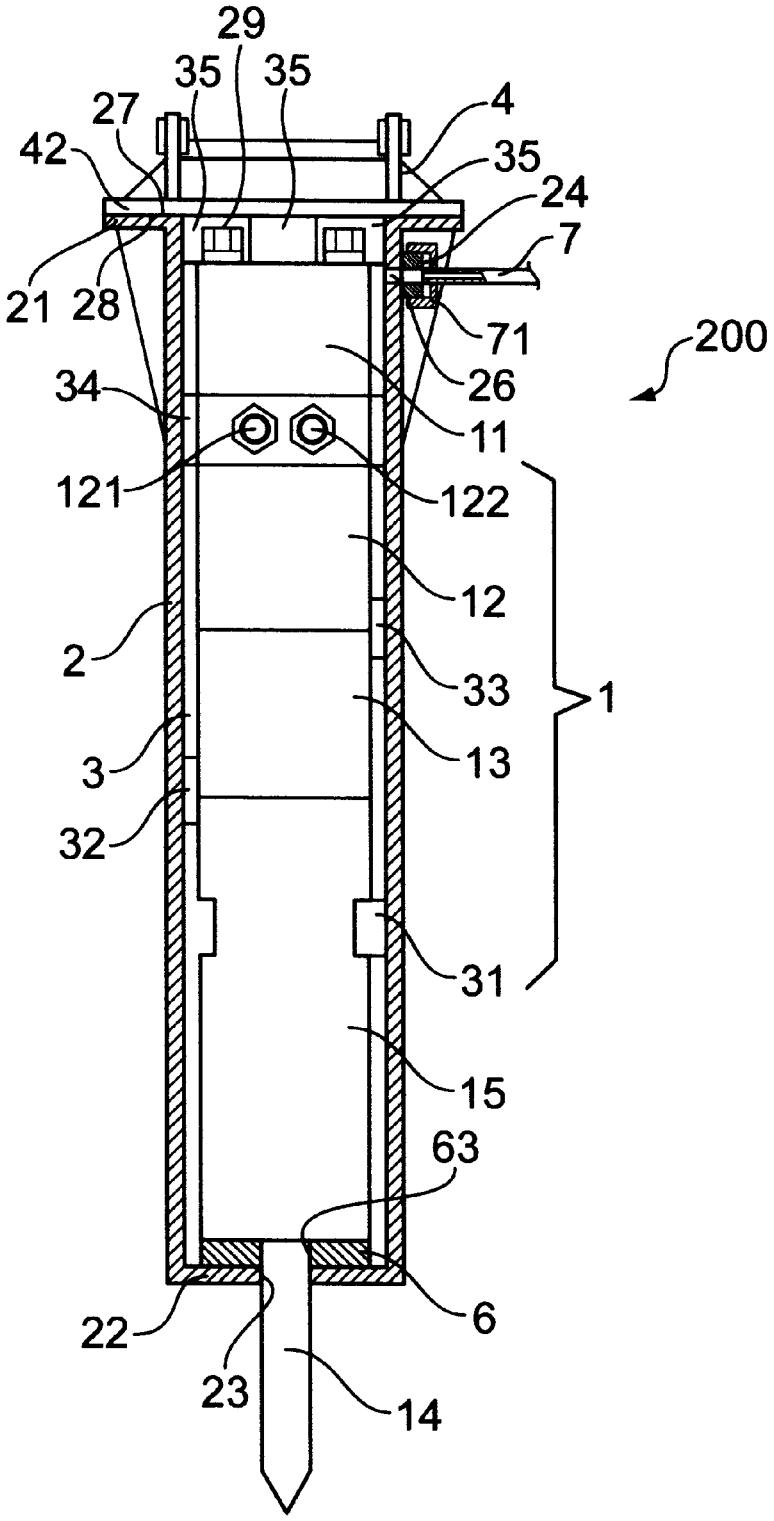
FIG. 1 is a vertical sectional front view of the present invention.

Referring to FIG. 1, a main body 1 of breaker 200 includes a cap portion 11, a cylinder and valve chamber having a valve region 12 and a piston cylinder 13, and a front head 15. Impact tool 14 protrudes from front head 15 and is reciprocated by a hammer of front head 15 which is driven by movement of cylindrical piston 13. Hydraulic inlet 121 and outlet 122 are connected to valve 12 within body 1 to drive piston cylinder 13. A more detailed explanation of the structure and operation of breaker 200 is given by the following description.

A connecting plate 42 for bracket 4 is connected to a head connector 21 of outer housing 2 to support outer housing 2 after main body 1 and impact tool 14 are inserted into the inside of outer housing 2 with a space between main body 1 and outer housing 2. In another embodiment, bracket 4 may be connected to a portion extending from cap 11 of main body 1. In this instance, bracket 4 can be connected to or fixed on both outer housing 2 and main body 1.

Outer housing 2 includes a front cover 22 having a first guide hole 23. Impact tool 14 of the breaker moves reciprocally through first guide hole 23 of front cover 22 during operation of the breaker. A lower absorber 6, such as polyurethane or nitrile-budadiene rubber, is disposed and inserted between front cover 22 of outer housing 2 and front head 15 of main body 1 of the breaker before main body 1 is inserted into the inside of outer housing 2 and includes a second guide hole 63 that allows impact tool 14 to move reciprocally through both first and second guide holes 23 and 63 during operation of the breaker lower absorber 6 is tightly inserted between and attached to both the bottom side of front head 15 and the inner side of front cover 22 to seal the space 3. An upper absorber 35, such as polyurethane or nitrile-budadiene rubber, is disposed and inserted between cap 11 of main body 1 to seal the space 3 and connecting plate 42 of bracket 4 after main body is inserted into the inside of outer housing 2. In another embodiment, upper absorber 35 can be disposed between cap portion 11 and head connector 21 of outer housing 2. Side absorbers 31, 32, 33 and 34 shown in FIG. 1, 36, 37, 38 and 39 shown in FIG. 3, such as polyurethane or nitrile-budadiene rubber, are attached to side surface of main body 1 and disposed between main body 1 and outer housing 2. Upper absorber 35, lower absorber 6, and side absorbers 31, 32, 33, 34 support main body 1 against outer housing 2 and absorb vibration and noise generated by the main body 1 of breaker 200 while upper absorber 35 and lower absorber 6 seal space 3.

A fluid hole 26 is formed on outer housing 2. Fluid bolt 24 having a central hole is fixed around fluid hole 26 of outer housing 2, and a collar 71 is connected to bolt 24. Fluid hose 7 is connected to the collar 71, thereby fluid hole, central hole of bolt 24, collar 71, and fluid hose 7 form a passageway for liquid, such as water, to be supplied into space 3. Space 3 between outer housing 2 and main body 1 is filled with water supplied through fluid hose 7, collar 71, fluid bolt 24, and fluid hole 26 of outer housing 2. Main body 1 and outer housing are properly sealed. Hydraulic inlet 121 and outlet 122 formed on main body 1 are connected to hydraulic hoses (not shown) through hydraulic holes in outer housing 2. The water that fills space 3 between outer housing 2 and main body 1 absorbs and reduces vibration and noise generated by main body 1. The quantity of water that fills space 3 is maintained by continuously supplying water into space 3 through fluid hose 7 connected to outer housing 2.

Figure 2:
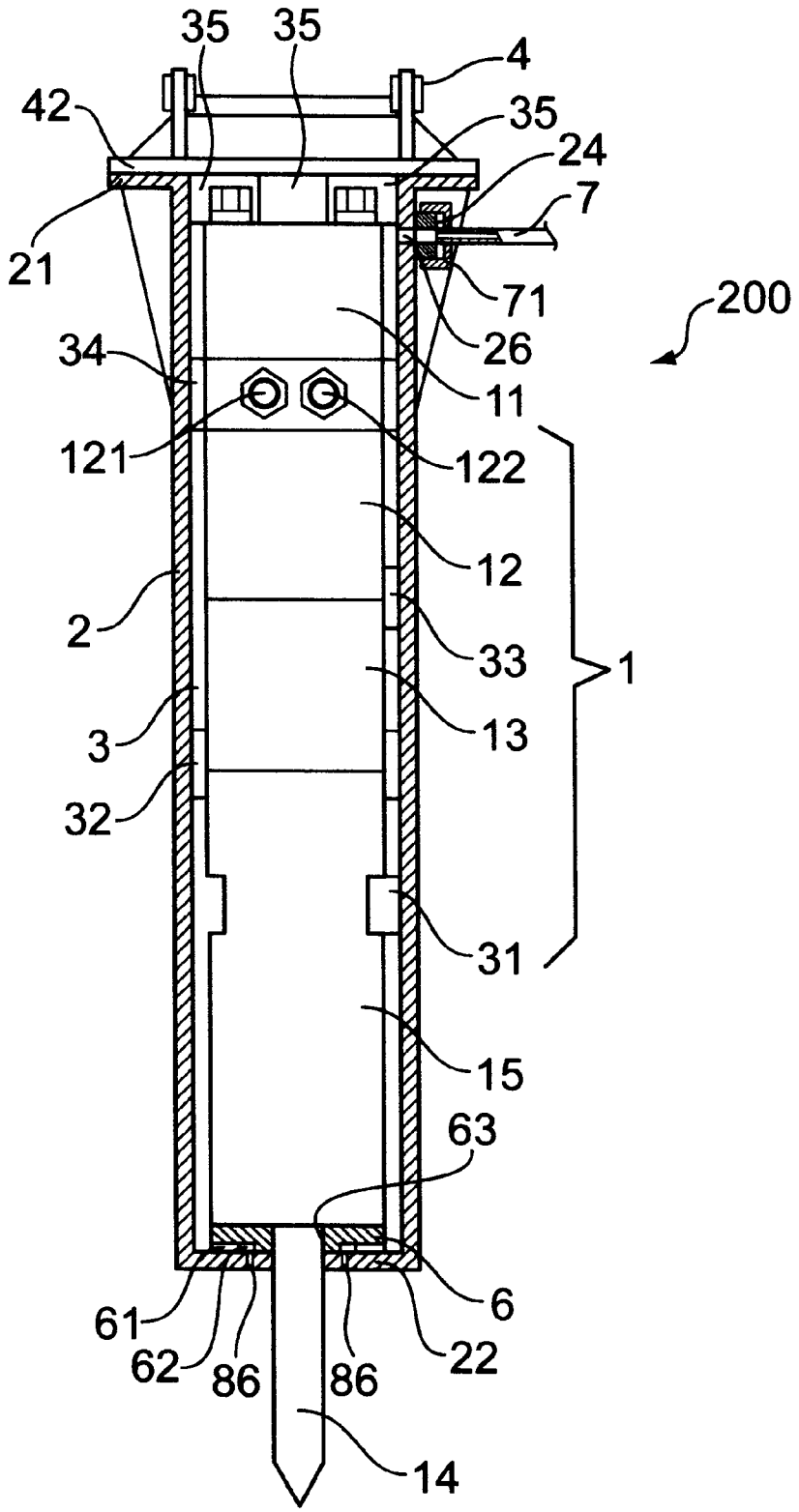
FIG. 2 is a vertical sectional front view illustrating another embodiment of this invention.
Figure 4:
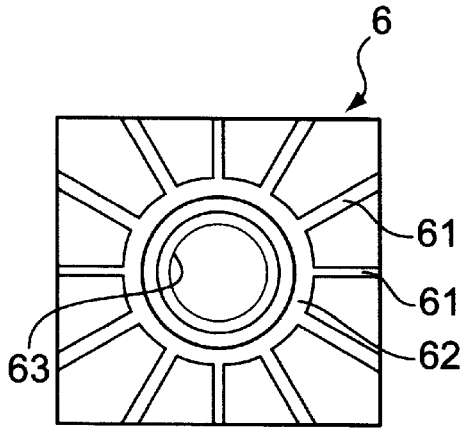
FIG. 4 is a bottom view of a lower absorber of FIG. 2.

FIGS. 2 and 4 show another embodiment of lower absorber 6. Lower absorber 6 may be constructed to include a plurality of radial passages 61, an annular passage 62, and second guide hole 63. A plurality of discrete holes form an array of a plurality of nozzles 86 on front cover 22 of outer housing 2. Water that fills space 3 passes sequentially through radial passages 61 and annular passage 62 and is finally ejected through nozzles 86. The water can be ejected directly through nozzles 86 without passing through the passages formed on the absorber if the nozzles are formed through an area of the outer housing 2 that is not covered by absorber 6. The ejected water tends to stream around the tip of impact tool 14.

During operation of the breaker, impact tool 14 breaks up a solid object, such pavement, rock or other rigid material, and scatters debris and dust. In this instance, the scattered debris and dust from around the tip of impact tool 14 can be reduced water significantly by the water ejected via nozzles 86. The quantity of water that fills space 3 is maintained by supplying water to space 3 through fluid hose 7 connected to outer housing 2. Thus, damage and injury caused by debris and dust can be reduced, and, both the user as well as nearby co-workers will have a modicum of protection from injury.

Figure 5:
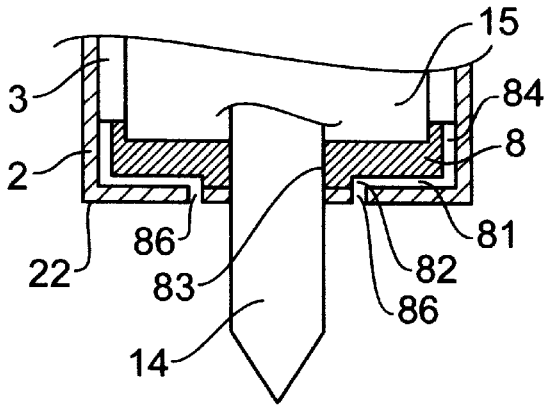
FIG. 5 is a partial sectional view showing another preferred embodiment of the lower absorber.
Figure 6:
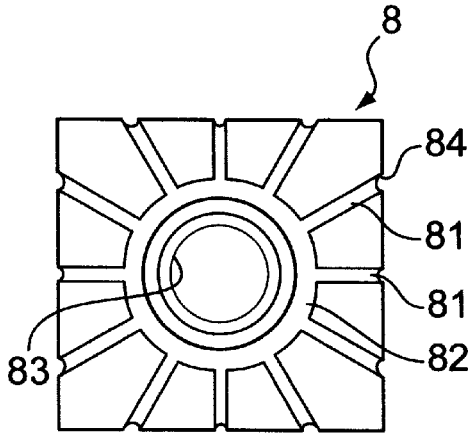
FIG. 6 is a bottom view of the lower absorber of FIG. 5.

FIG. 5 and FIG. 6 show another prefected embodiment of lower absorber 8 suitable for use in the practice of the present invention. Lower absorber 8 is disposed both between bottom side of front head portion 15 and front cover 22 of outer housing 2 and between side surface of front head portion 15 and sidewall of outer housing 2. Lower absorber 8 extends to lower portion of space 3. Vertical passages 84 are formed on the lower absorber 8 and are connected to a annual passage 82 through corresponding radial passages 81. Water passes from space 3 through vertical passages 84, radial passages 81, and annular passage 82 and finally is ejected through nozzles 86 formed on front cover 22 of outer housing 2.

Figure 3:
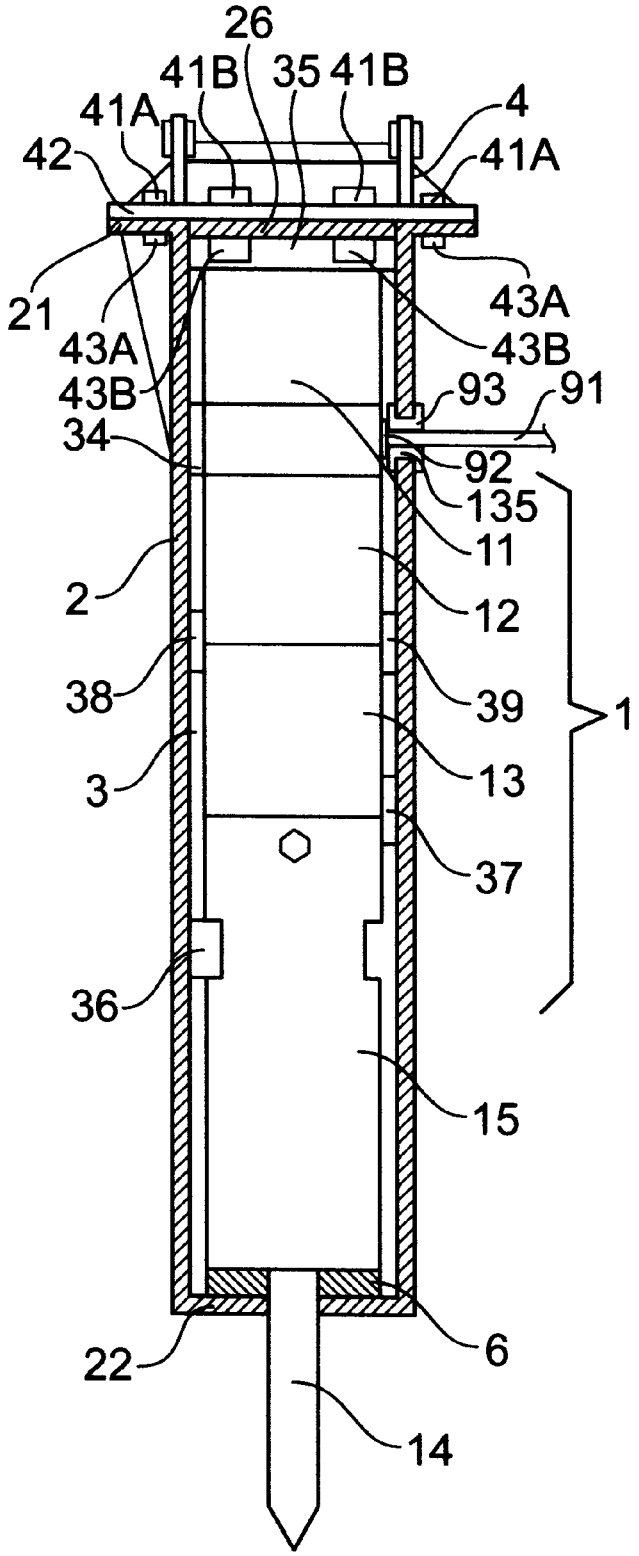
FIG. 3 is a vertical sectional view illustrating a hydraulic inlet and outlet in the embodiment shown by FIG. 1.

FIG. 3 shows the hydraulic inlet and outlet of FIG. 1. Adapter 92 is fixed to main body 1. Hydraulic hose 91 is connected to adapter 92 while seal packing 93, such as rubber, for sealing and absorbing vibration generated by main body 1 is inserted between hydraulic hole 135 of outer housing 2 and hydraulic hose 91. Hydraulic inlet 121 and outlet 122 have the same structure as adapter 92, hydraulic hose 91, and seal packing 93. Two hydraulic holes 135 are formed on outer housing 2 and are used for hydraulic inlet 121 and outlet 122. Head connector 21 of outer housing 2 is connected to connecting plate 42 by bolts 43A and nuts 41A. A seal washer is inserted between bolt 43 A of head connector 21 and nut 41A of connecting plate 42. An extension plate 26 extended from or fixed to cap portion 11 of main body 1 is connected to connecting plate 42 by bolts 43B and nuts 41B. A seal washer is inserted between nut 41B of connecting plate 42 and bolt 43B of extension plate 26. Upper absorber 35 is inserted between extension plate 26 and connecting plate 42 to seal space 3. A gasket for sealing and packing may be inserted between extension plate 26 of main body 1 and head connector 21 of outer housing 2 and between connecting plate 42 of frame 4 and head connector 21 of outer housing 2.

Upper absorber 35 has a lot of bolt holes accommodating bolts 43B of extension plate 26 located inside of outer housing and bolts located on cap portion 11 of main body 1. Head connector 21 is fixed and welded to the outer housing and is connected to the connecting plate of bracket 4 by using bolts 43A and nuts 41A. In the constitution of an alternate embodiment, only bolts shown outside of outer housing 2 may be used to connect outer portion 28 of head connector 21 of outer housing 2 to outer portion 27 of connecting plate 42 of bracket 4. In this alternative embodiment, head connector 21 of outer housing 2 has opening 29 (as shown in FIG. 1) to connect the extended portion of main body 1 to bracket 4 or to allow upper absorber 35 to be located between connecting plate 42 of bracket 4 and cap portion 11 of main body 1. Upper absorber 35 may have holes to accommodate only bolts of cap portion 11 of main body 1 as shown in FIG. 1.

Figure 7:
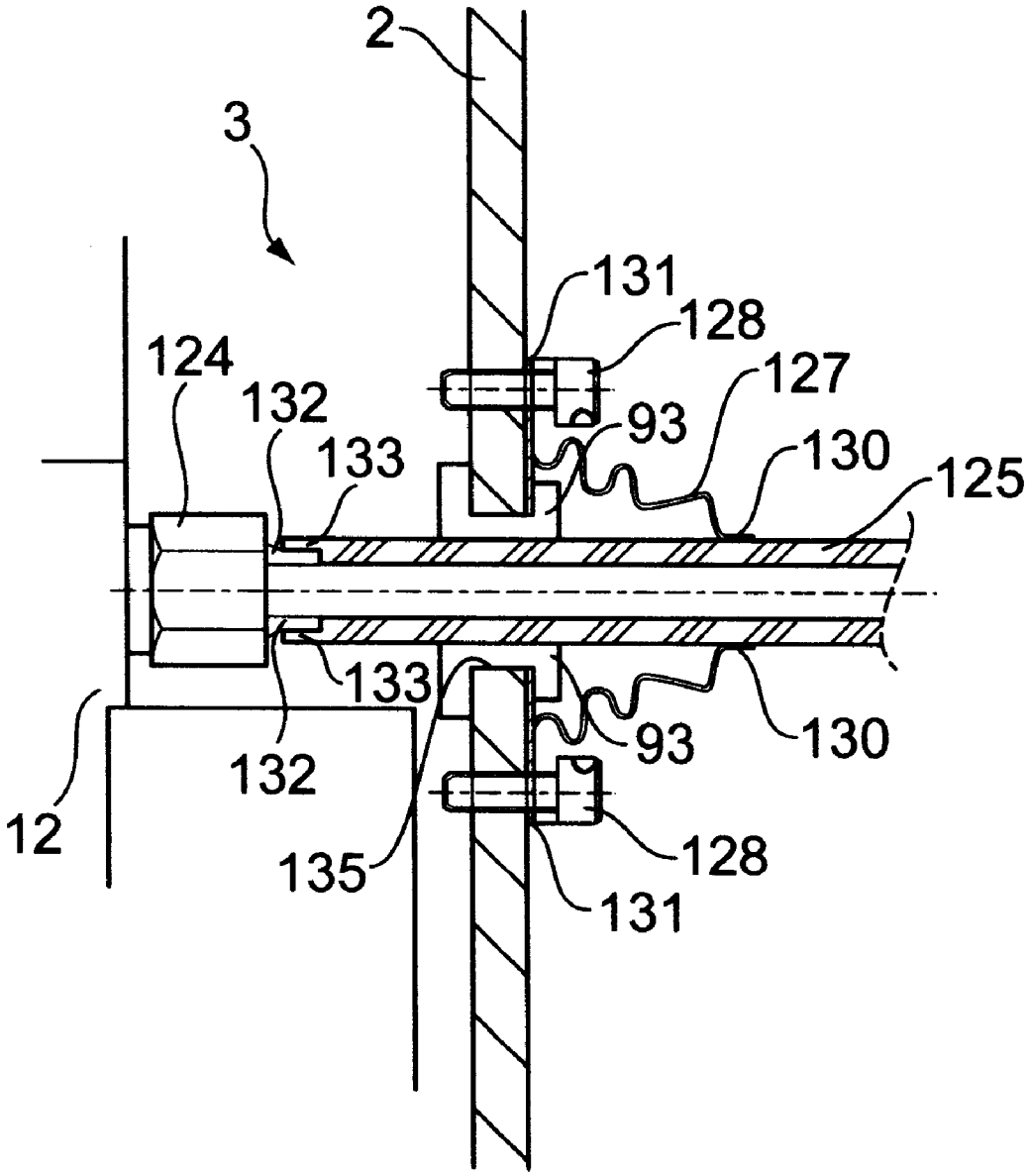
FIG. 7 shows another embodiment providing a hydraulic inlet and outlet.

Referring to FIG. 7, another preferred embodiment of the hydraulic inlet and outlet is provided. Adapters 124 for each hydraulic inlet 121 and outlet 122 are fixed and welded to valve portion 12 of main body 1. Threaded screws structure 132 are formed on adapters 124. Hydraulic hose 125 is inserted and attached by threading to structure 132 through hydraulic hole 135 while the female threads formed on the inside of front end 133 of hydraulic hose 125 is connected to the male threaded portion formed on outer surface of screw structure 123. Seal packing 93 is disposed to form a leakproof junction between hydraulic hole 135 and hydraulic hose 125. Before seal packing 93 is inserted into hydraulic hole 135, one end of seal cover 127 is inserted between seal packing 93 and outer housing 2. After hydraulic hose 125 is attached to valve region 12 of main body 1 through seal packing 93, screw structure 132, and adapter 124, then seal cover 127 is fitted to both outer housing 2 and hydraulic hose 125. Outer end 131 of seal cover 127 is clamped between outer housing 2 and seal bolt 128. Seal bolt 128 is threaded into outer housing 2. Inner end 130 of seal cover 127 is fitted around of the periphery hydraulic hose 125. Together, packing seal 93 and seal cover 127 prevent water from leaking.

Figure 8:
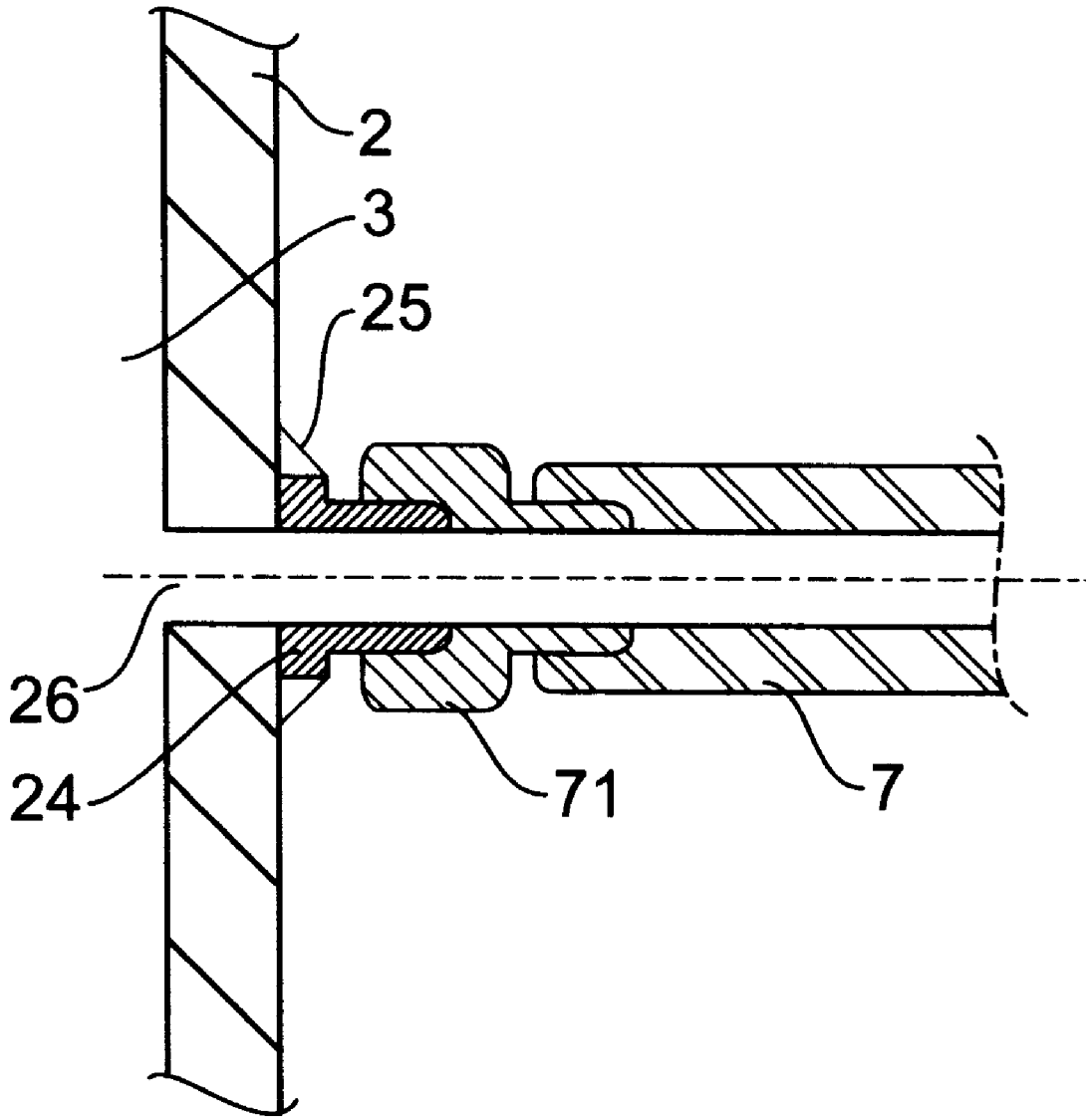
FIG. 8 shows another embodiment of the fluid hose constructed according to the principle of the present invention.

Another preferred embodiment providing coupling of the fluid hose 7 to outer housing is shown in FIG. 8. In this embodiment, nipple 24 is welded onto the exterior surface 25 of outer housing 2 while central hole of nipple 24 and fluid hole 26 form a passage through the wall of outer housing 2. Collar 71 is connected to nipple 24, and fluid hose 7 is connected to collar 71. Collar 71 has one end connected to nipple 24 and the other end connected to fluid hose 7. Water is supplied from outside of main body 1 to the space 3 formed between outer housing 2 and main body 1 of breaker through fluid hose 7, collar 71, nipple 24, and fluid hole 23. The supply of water can be controller by a fluid regulator (not shown). When hydraulic breaker 200 is operated, the controller controls to continue to supply water through the fluid hose, and when hydraulic breaker 200 stops operating, regulator interrupts the supply of water. The supply of water can be dependent on the operation of breaker 200. During the supply of a liquid phase fluid such as water, water in space 3 is ejected through the nozzle holes 86 of the front cover 22 of the outer housing 2. Water within space 3 is not ejected when the regulator stops supplying water.

Figure 9:
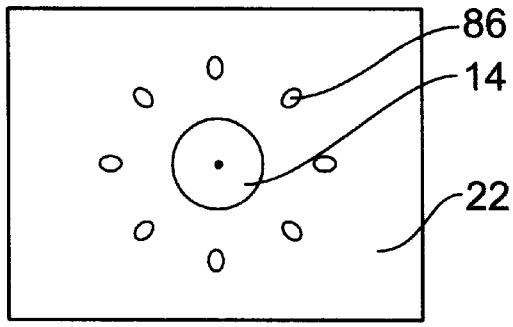
FIG. 9 shows a bottom view of the breaker according to present invention.
Figure 10:
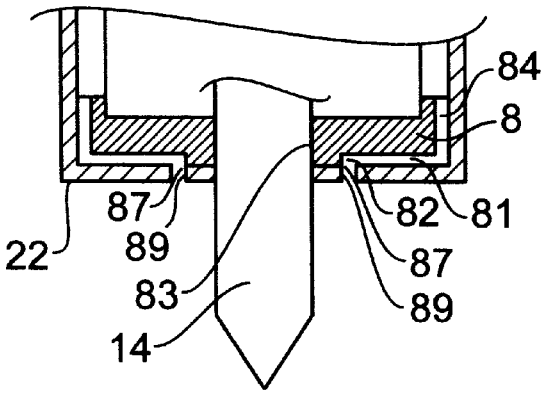
FIG. 10 is a partial sectional view showing another preferred embodiment of the nozzles.
Figure 11:
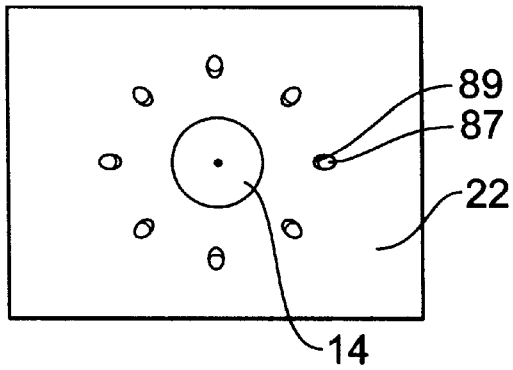
FIG. 11 shows a bottom view of the breaker of FIG. 10.
Figure 12:
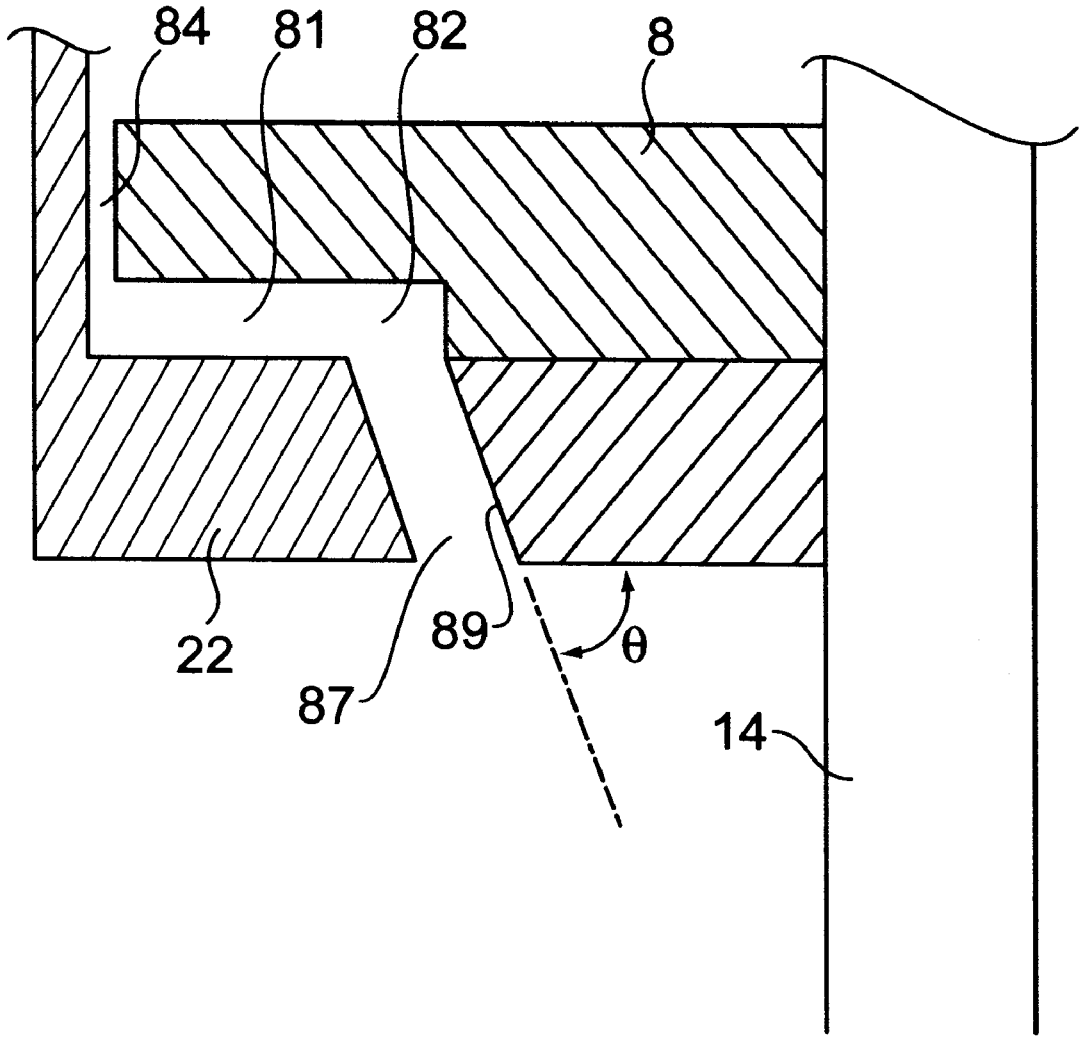
FIG. 12 shows a detailed sectional view of FIG. 10.

FIG. 9 shows a bottom view of the breaker of FIG. 5. Nozzle 86 formed on front cover 22 of outer housing 2 are shown around impact tool 14. FIG. 10 is a partial sectional view showing another preferred embodiment of nozzles 87. Nozzles 87 are formed on front cover 22 of outer housing and are communicating with space 3 while perforating outer housing 2 in an array oriented toward a tip of impact tool 14. Water passes through vertical passage 84, radial passages 81, and annual passage 82, and is finally ejected toward the tip of impact tool 14 through nozzles 87. Sidewalls 89 of nozzles 87 are shown around impact tool 14 in FIG. 11. FIG. 12 shows a detailed structure of nozzles 87. Nozzles 87 includes an inclined cylindrical sidewalls 89 having, an angle θ with front cover 22. The angle θ is depending on the direction of the water which is ejected.

According to the principles of this invention, the regulated ejection of a fluid from a plurality of nozzles to form a stream that sheaths the tips of the impact tool provides absorption of vibration and noise during operation of the breaker, while preventing debris and noise from scattering. While this invention has been described in connection with what is presently considered to be the most practical and the disclosed embodiments, but it is to be understood that the invention is not limited to the disclosed embodiments, but, on the contrary, is intended to cover various modifications and equivalent arrangements included within the sprit and scope of the invented claims.

What is claimed is:

1. A breaker, comprising:

a main body including a cylinder, a valve chamber and a distal end holding a proximal end of an impact tool;

an outer housing having a bracket connected to said main body, having a cylindrical body connected to said bracket and accommodating said main body while providing a space between said main body and said outer housing;

a first inlet and outlet formed on said outer housing, passing through said space, coupled to said main body, supplying said main body with a first fluid and exhausting said first fluid from said main body;

a second inlet formed on said outer housing, communicating with said space, supplying said space with a second fluid;

a plurality of absorbers of a resilient material disposed within said space to maintain a separation between said outer housing and said main body; and a plurality of nozzles communicating with said space and said second inlet while perforating a front cover of said outer housing in an array oriented toward a tip of said impact tool, ejecting said second fluid filled in said space and supplied through said second inlet, and further comprised of a lower absorber disposed between a lower portion of said main body and said front cover of said outer housing, including a passageway formed on said lower absorber, said passageway communicating with said nozzles and said space.

2. The breaker of claim 1, wherein said plurality of absorbers preserve said space communicating with said second inlet and said nozzles and filled with said second fluid.

3. The breaker of claim 1, further comprised of an upper absorber disposed between an upper portion of said main body and a bracket of said outer housing, said upper portion of said main body fixed to said bracket of said outer housing.

4. The breaker of claim 1, further comprised of a side absorber disposed between a sidewall of said outer housing and an outer circumferential surface of said main body while preserving said space communicating with both said second inlet and said nozzles.

5. The breaker of claim 1, further comprised of a lower absorber and a side absorber formed in a single body, including a passage allowing said fluid filled in said space to be ejected through both said passage and said nozzles to outside of said outer housing.

6. The breaker of claim 5, said lower absorber and said side absorber each having a first side contacting said main body and a second side contacting said front cover of said outer housing, said passage formed on said second side.

7. The breaker of claim 5, said passage comprising a radial passage communicating said space and a annular passage communicating both said radial passage and said nozzles.

8. The breaker of claim 1, said second inlet formed on an upper portion of said cylindrical body of said outer housing while said nozzle are formed on said front cover connected to a lower portion of said cylindrical body of said outer housing.

9. The breaker of claim 1, said second inlet comprising a hole formed on said cylindrical body, a connection collar attached around said hole, and a hose coupled to said connection collar and supplying said fluid into said space through said connection collar and said hole.

10. The breaker of claim 1, said lower absorber having a first side contacting said main body and a second side contacting said front cover of said outer housing, said passageway formed on said second side without communicating with said first side.

11. The breaker of claim 1, said passageway comprising a radical passage communicating with said space and an annular passage communicating with both said radical passage and said nozzle.

12. The breaker of claim 1, said passageway comprising any one of a radical passage and an annular passage each communicating with said space and said nozzles.

13. A beaker, comprising:

a main body including a valve and a cylinder chamber, a front head portion connected to said valve and said cylinder chamber, an impact tool protruding from said front head portion and moving reciprocally, and a first inlet and outlet formed on said valve and cylinder chamber;

an outer housing having a bracket connected to said valve and said cylinder chamber of said main body, spaced-apart from said main body while accommodating said main body, including a front cover having a guide hole allowing said impact tool to move reciprocally through said guide hole, having a first hole and a second inlet, said first inlet and outlet extending from said main body while passing through both said hole and said space, said second inlet communicating with said space and supplying said space with a fluid;

a plurality of absorbers disposed within said space to maintain a separation between said outer housing and said main body; and a plurality of nozzles formed on said front cover, communicating with said space and said second inlet, and further comprised of an absorber disposed between said front cover of said outer housing and a front head portion of said main body, including a passageway formed on said lower absorber, said passageway communicating with said nozzles and said space.

14. The breaker of claim 13, wherein said space being filled with said fluid.

15. The breaker of claim 13, wherein the front cover absorber seals said space while allowing said impact tool to move reciprocally.

16. The breaker of claim 13, said second inlet having a second hole formed on said outer housing and connected to a hose supplying fluid into said space through said second hole.

17. The breaker of claim 13, further comprising a lower absorber disposed between said front cover of said outer housing and said front head portion of said main body, having a first side and second side, having a passageway formed on said second side contacting said front cover while said first side contacts said front head portion of said main body.

18. The breaker of claim 17, said passageway comprising a radial passage communicating with said space and an annular passage communicating with both said radial passage and said nozzle.

19. The breaker of claim 17, said passageway comprising any one of a radial passage and an annular passage each communicating with both said space and said nozzles.

20. The breaker of claim 13, further comprising a lower absorber and a side absorber made in a single body, said lower absorber disposed between said front cover and said front head position, said side absorber disposed between a cylindrical body of said outer housing and a circumferential outer side of said main body, said lower absorber and said side absorber having a passageway communicating with said space, said second inlet, and said nozzles.

21. The breaker of claim 20, said passageway comprising any one of a radial passage and an annular passage each communicating with both said space and said nozzles.

22. The breaker of claim 13, said nozzle including a center having an angle with respect to said front cover.

23. A breaker, comprising:

a main body including a valve and a cylinder chamber, a front head portion connected to said valve and cylinder chamber, an impact tool protruding from said front head portion and moving reciprocally, and a first inlet and outlet formed on said valve and cylinder chamber;

an outer housing having a bracket connected to said valve and cylinder chamber of said main body, spaced-apart from said main body while accommodating said main body inside said outer housing and providing a space between said outer housing and said main body, including a front cover having a guide hole allowing said impact tool to move reciprocally through said guide hole, having a first hole and a second inlet, said first inlet and outlet extending from said main body while passing through both said hole and said space, said second inlet communicating with said space and supplying said space with a fluid;

a plurality of nozzles formed on said front cover, communicating with said space and said second inlet;

a first absorber disposed within said space to maintain a first separation between said valve and cylinder chamber and said outer housing; and a second absorber disposed within said space to maintain a second separation between said front cover and said front head portion, including a passageway formed in said second absorber, said passageway communicating with said nozzles and said space.

24. The breaker of claim 23, said first absorber and said second absorber made of a single body, having said passageway communicating said second inlet and said nozzles.

25. The breaker of claim 23, said passageway comprising a radial passage communicating said second inlet and an annular passage communicating with both said radial passage and said nozzle.

26. The breaker of claim 23, said passageway comprising any one of a radial passage and an annular passage each communicating said second inlet and said nozzle.

* * * * *